US005154817A

United States Patent [19]

Reid

[11] Patent Number: 5,154,817

[45] Date of Patent: Oct. 13, 1992

[54] METHOD FOR INHIBITING GUM AND SEDIMENT FORMATION IN LIQUID HYDROCARBON MEDIUMS

[75] Inventor: Dwight K. Reid, Houston, Tex.

[73] Assignee: Betz Laboratories, Inc., Trevose, Pa.

[21] Appl. No.: 528,293

[22] Filed: May 24, 1990

[51] Int. Cl.[5] ..... C10G 9/00; C10G 9/12

[52] U.S. Cl. ..... 208/48 AA; 585/950; 44/434; 208/213; 208/255; 208/48 R; 208/47; 208/348

[58] Field of Search ..... 44/51, 58, 70, 72, 75, 44/434; 208/213, 255, 48 AA; 585/950

[56] References Cited

U.S. PATENT DOCUMENTS

| | | | |
|---|---|---|---|
| 1,989,528 | 1/1935 | Rather et al. | 44/434 |
| 2,695,222 | 11/1954 | Chenicek et al. | 44/434 |
| 2,793,944 | 5/1957 | Chenicek et al. | 44/434 |
| 2,840,461 | 6/1958 | Dunken et al. | 44/434 |
| 3,372,009 | 3/1968 | Waldmann | 44/434 |
| 3,676,483 | 7/1972 | Hu | 260/475 |
| 4,024,083 | 5/1977 | Kablaoui et al. | 252/51.5 |
| 4,029,589 | 6/1977 | Knepper et al. | 44/73 |
| 4,055,402 | 10/1977 | Ballersby et al. | 44/58 |
| 4,204,481 | 5/1980 | Malec | 44/57 |
| 4,342,657 | 8/1982 | Blair, Jr. | 252/8.55 |
| 4,384,968 | 5/1983 | Polizzotti et al. | 252/60 |
| 4,430,196 | 2/1984 | Niu | 585/950 |
| 4,451,265 | 5/1984 | Schwap | 44/57 |
| 4,477,362 | 10/1984 | Steckel | 252/51.5 |
| 4,527,995 | 7/1985 | Itow et al. | 44/57 |
| 4,549,885 | 10/1985 | Knapp | 44/57 |
| 4,693,789 | 9/1987 | Berg et al. | 203/51 |
| 4,726,810 | 2/1988 | Ignasiak | 44/57 |
| 4,752,374 | 6/1988 | Reid | 208/48 |
| 4,780,111 | 10/1988 | Dorer et al. | 44/73 |
| 4,806,229 | 2/1989 | Ferguson et al. | 585/450 |
| 4,840,720 | 6/1989 | Reid | 208/48 |

*Primary Examiner*—Helane E. Myers

*Attorney, Agent, or Firm*—Alexander D. Ricci; Bruce E. Peacock

[57] ABSTRACT

Gum and sediment formation in liquid hydrocarbon mediums are inhibited by adding to the medium a branched or straight chain $C_1$–$C_8$ aminoalcohol. The invention is particularly well-suited for use in hydrodesulfurizer processes wherein the hydrocarbon medium is typically a naphtha, diesel, kerosene, light gas and or residual fuel charge and the charge or medium is subjected to high temperature and pressure treatment in the presence of a catalyst. The invention also shows particular advantage in distillate fuels, such as in blended diesel fuels, both before and during heat treatment processing thereof.

28 Claims, No Drawings

METHOD FOR INHIBITING GUM AND SEDIMENT FORMATION IN LIQUID HYDROCARBON MEDIUMS

FIELD OF THE INVENTION

The present invention pertains to methods for inhibiting gum and sediment formation in liquid hydrocarbon mediums by the addition of straight or branched chain $C_1$-$C_8$ aminoalcohols thereto.

BACKGROUND OF THE INVENTION

In the processing of petroleum hydrocarbons and feedstocks such as petroleum processing intermediates, and petrochemicals and petrochemical intermediates, e.g., gas, oils and reformer stocks, chlorinated hydrocarbons and olefin plant fluids such as deethanizer bottoms, the hydrocarbons are commonly heated to temperatures of 100° to 2000° F., frequently from 600°-1000° F. Similarly, such petroleum hydrocarbons are frequently employed as heating mediums on the "hot side" of heating and heating exchange systems.

During such heat processing, and even during ambient temperature transportation and storage, sediment, sludge and/or gummy masses often form with undesirable results. The so-formed sediment, sludge or gums may cause clogging of equipment or fouling of processing equipment (such as heat exchangers, compressors, furnaces, reactors and distillation systems).

Oftentimes, the gummy masses or sediment are catalytically formed by the undesirable presence of metallic impurities such as copper and/or iron that are present in the petroleum hydrocarbon or petrochemical.

In the hydrocarbon processing industry, there are several environments where the need for protection against sediment and gum formation is felt. For example, in a refinery, the crude unit has been the focus of attention, primarily because fuel usage directly impacts on processing costs. Chemical additives have been successfully applied at the heat exchangers, both downstream and upstream from the desalter, on the product side of the preheat train, on both sides of the desalter makeup water exchanger, and at the sour water stripper.

The distillate streams which can result in significant fouling, including the straight-run distillates (kerosene, diesel, jet), naphthas, lube oils, catalytic cracker feedstocks (gas oils), light and heavy cycle oils, coker naphthas, resids and petrochemical plant feedstocks.

The need to inhibit or minimize gum and sediment formation is also felt in conjunction with unsaturated and saturated gas plants such as refinery vapor recovery units, in catalytic cracker units both at the vacuum unit and at the cracker itself, and in heavy oil treating and cracking units.

Another troublesome area prone to gum and sediment formation is that of the hydrodesulfurizer (H.D.S.) process. Hydrodesulfurization is designed to improve the qualities of a wide range of petroleum stocks by removing sulfur, nitrogen and heavy metallic contaminants and also to saturate the petroleum stocks with hydrogen. Feedstocks to such units may comprise naphthas, kerosene, fuel oils, diesel fuels and residual fuels.

Common hydrodesulfurization applications include pretreatment of catalytic reforming feedstocks and desulfurization of fuel oils. Reformer feedstocks are processed in a hydrodesulfurizer to remove sulfur, nitrogen and arsenic which are poisonous to the reforming catalyst. Fuel oils are upgraded in a hydrodesulfurizer by removing mercaptans and sulfur which cause foul odors and pollution.

The main steps in a HDS process are: feedstock preheating, catalytic reaction, and product purification. In the preheating stage of the process, feed/effluent exchangers normally heat feedstock from ambient to about 450°-500° F. Hydrogen may be added to the feedstocks either prior to the exchangers or after. The degree of vaporization varies depending on temperature, feedstock, pressure, and hydrogen content. During the preheating stage, the reactor heats the feed from the preheat effluent temperature to the reactor inlet temperature of about 650° F.

In the reactor section of the HDS unit, a catalyst, such as a Ni-Mo, Co-Mo, or Ni catalyst is normally held in a fixed bed. Metals are retained by the catalyst without seriously affecting its activity over long periods. Sulfur, nitrogen and oxygen compounds are decomposed to the corresponding hydrocarbon with liberation of $H_2S$, $NH_3$ and water. If organic chlorides are present, HCl is formed.

The following equations illustrate the reactions in the reactor section of an HDS unit (1) $RSH + H_2 \rightleftharpoons RH + H_2S$ (2) $RCl + H_2 \rightleftharpoons RH + HCl$ (3) $2RN + 4H_2 \rightleftharpoons 2NH_3 + RH$ (4) $ROOH + 2H_2 \rightleftharpoons RH + H_2O$ Typical operating conditions for the hydrodesulfurization reactions are:

| | |
|---|---|
| Temperature, °F. | 600-780 |
| Pressure, psig | 600-3000 |
| $H_2$ Recycle rate, SCF/barrel | 1500-3000 |
| Fresh $H_2$ makeup, SCF/barrel | 700-1000 |

In the HDS purification section, cooling water is used to quench the reactor effluent prior to product separation. The separator or flash drum allows the hydrogen, $H_2S$, and $NH_3$ to flash overhead allowing the liquid process hydrocarbon to continue as bottoms. Water can be removed from the separator drum(s) by level control. The stripper or fractionator, as it is sometimes referred to, uses heat to strip off remaining sour gases. The heat source can be in the form of a stripping steam, a thermal syphon reboiler, or a fired reboiler. The stripper bottom leaves the unit as a final effluent, while the overhead vapors go to an amine contactor and the overheat liquids may go to sour water stripping.

HDS units have become an increasingly important part of refinery processes over the last few years. Removal of sulfur and metals from the feedstock affords important protection for the expensive catalysts used in reformers, cat crackers, and hydrocrackers. Also, air quality regulations seeking to lower the allowable sulfur content in airborne emissions coupled with the use of high sulfur content crudes emphasizes the need for such HDS units.

In addition to use to inhibit sediment and gum formation in HDS units and the sundry other environments specified supra., the present invention can be used in pyrogas units wherein higher molecular weight hydrocarbons, such as those in gas oils, are either catalytically cracked or thermally cracked.

Petrochemical systems, like the petroleum refinery systems noted above, also are adversely affected by gum and sediment accumulation in the process fluid. For example, such problems have been encountered in ethylene and styrene plants. In ethylene plants, furnace gas compressors, fractionating columns and reboilers have all experienced these problems. In butadiene plants, absorption oil fouling and distillation column and reboiler fouling provide troublesome problems that must be overcome to provide process efficiencies.

Accordingly, there is a need in the art to provide for a chemical additive treatment that is adapted to inhibit gum and sediment formation in a liquid hydrocarbonaceous medium. There is also a need for such a treatment that is capable of performing its intended function during the high temperature 100°-2000° F. heat processing of such mediums in accordance with refinery and petrochemical processes. An even more specific need exists for a treatment that is effective in heretofore troublesome processes such as distillation and HDS processes, pyrolytic gasoline processes and in butadiene plants.

SUMMARY OF THE INVENTION

The above and other objects of the invention are met by the addition of a $C_1$-$C_8$ branched or straight chain aliphatic aminoalcohol, preferably a $C_1$-$C_8$ alkanolamine compound or compounds, to the desired liquid hydrocarbonaceous medium. From about 1-10,000 ppm of such compound or compounds is added to the liquid hydrocarbon, with a more preferred range of addition being about 1-1500 ppm based upon one million parts of the liquid hydrocarbon.

As used herein, the phrase "liquid hydrocarbonaceous medium" signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residual, light and heavy cycle coils, coker naphthas, etc., may all be benefitted by using the treatments herein disclosed and claimed.

Similarly, petrochemicals such as olefinic or naphthenic process streams, ethylene glycol, aromatic hydrocarbons and their derivatives may all be successfully treated using the inventive treatments herein described and claimed and are within the ambit of the phrase.

Preferably, the aminoalcohol compound comprises 2-amino-2-methyl-1-propanol dissolved in an organic nonpolar solvent, such as heavy aromatic naphtha. A cosolvent, such as octanol, is preferably used to increase the solubility of the aminoalcohol.

PRIOR ART

Alkanolamines are well known and have been reported for a wide variety of uses. Ethanolamine, for example, is used as a scrubber liquid for scrubbing acid gases, such as $H_2S$ and $CO_2$. Alkanolamines, in general, are reported in U.S. Pat. No. 4,384,968 (Polizotti et al—of common assignment herewith) as being useful adjuvants for conjoint use with morpholine as electrostatic precipitator efficiency enhancing treatments.

Patents directed toward the general field of antifouling protection of hydrocarbonaceous liquids, such as distillate fuels, etc., include U.S. Pat. No. 4,752,374 (Reid—of common assignment herewith)—disclosing use of organo-phosphites and $C_2$-$C_{20}$ carboxylic acids as effective antifouling treatments and U.S. Pat. No. 4,840,720 (Reid—of common assignment herewith)—disclosing conjoint use of organo-phosphites and hydroxylamines.

Other patents which may be of some interest to the present invention include U.S. Pat. No. 4,477,362 (Steckel) disclosing lubricant and fuel additives that are reaction products of an aliphatic hydroxy compound with a (tertiary amino) alkanol. U.S. Pat. Nos. 3,676,483 (Hu); 4,342,657 (Blair); 4,024,083 (Kablaoui et al); and 4,693,789 (Berg et al) are also mentioned as being of possible interest.

DETAILED DESCRIPTION OF THE PREFERRED EMBODIMENT

The present invention pertains to a process for inhibiting the formation of gums and sediment in liquid hydrocarbonaceous mediums by adding to such mediums an effective antifouling amount of a $C_1$-$C_8$ branched or straight chain aliphatic aminoalcohol. More specifically, these aminoalcohols are $C_1$-$C_8$ alkanolamines wherein, even more specifically, the $NH_2$ and OH substituents are located on vicinal carbon atoms.

Exemplary $C_1$-$C_8$ alkanolamines having vicinal OH and $NH_2$ substituents include:

2-amino-2-methyl-1-propanol
1-amino-2-hydroxyethane (monoethanolamine)
2-amino-2-ethyl-1,3-propanediol
1-amino-2,3-dihydroxy propane
1-amino-2,3,4-trihydroxy butane
2-amino-2-ethyl-1-propanol
2-amino-1-propanol
1-amino-2-butanol
3-amino-2-butanol The alkanolamine treatments of the present invention may be added to the requisite liquid hydrocarbon neat or it, or mixtures of the alkanolamines, may be dissolved in a non-polar solvent such as heavy aromatic naphtha (H.A.N.), xylene, etc.

The treatment of the present invention is particularly well suited for inhibiting degradation, particulate formation and gum formation of distillate fuels prior to or during processing thereof at temperatures of from about 100°-1000° F. The invention is particularly well suited for use in conjunction with the so-called middle distillates including heavy naphthas (white gas), kerosene, light diesel oil, heating oil and heavy diesel oil. Typically, these middle distillates have boiling points within the range of about 200°-650° F. and are further characterized by having an API gravity of from about 33-56.

The treatment of the present invention is also well suited to inhibit gums and sediments that may be formed during HDS processes. As such, the alkanolamines can be added directly to the HDS feedstock prior to preheating thereof, or can be added to the preheater itself or to the HDS reactor. The treatment is especially well adapted to operate under the temperature (e.g., 450°-780° F.) and pressure (e.g., 600-3000 psig) conditions normally encountered in such H.D.S. processes.

The alkanolamines are added to the liquid hydrocarbon in an amount of from 1.0 part to about 10,000 parts per million of liquid hydrocarbon with the addition range of about 1-1500 ppm being preferred.

Although preferred for use with the so-called middle distillate fuels and in H.D.S. applications, distillate fuels generally will benefit from the invention. As used herein, distillate fuels are those fuel oils having hydrocarbon components distilling from about 100° F. to about 700° F. included are straight-run fuel oils, thermally cracked, catalytically cracked, thermally reformed, and catalytically reformed oil stocks, naphthas, lube oils, light and heavy cycle oils, coker naphthas, lube oils, light and heavy cycle oils, coker naphthas, resids and petrochemical plant feedstocks, and blends thereof which are susceptible to deterioration and fouling. Preferably, the distillate fuel oil is a blend or mixture of fuels having hydrocarbon components distilling from about 200° F. to about 650° F.

The processes of the instant invention effectively inhibit the degradation, particulate and gum formation of the distillate fuel oils prior to or during processing, particularly when such fuel oils are subjected to elevated temperatures of from about 100° F. to about 800° F. The term "particulate formation" is meant to include the formation of soluble solids and sediment.

The alkanolamines may be added to the liquid hydrocarbon at ambient pressure and temperature to stabilize the liquid hydrocarbon, typically distillate fuel oil, during storage and prior to processing. They may also be introduced into the processing equipment during high temperature heat treatment of the process just upstream from troublesome fouling locations, such as heat exchangers.

Based upon presently available experimental data, it is preferred to use a solution of 2-amino-2-methyl-1-propanol dissolved in a H.A.N. and octanol co-solvent system. The aminoalcohol is present in a weight ratio of about 1-2 aminoalcohol:octanol co-solvent with the remainder of the solution comprising H.A.N.

EXAMPLES

In order to demonstrate the efficacy of the alkanolamines in inhibiting fouling deposits in liquid hydrocarbonaceous mediums, tests were conducted to compare gum sediment levels in untreated samples and samples treated in accordance with the invention. In some cases, commercially available antifoulant were tested for comparative purposes.

The hydrocarbon liquid and additive (if used) were heated (most often to reflux) for the time periods indicated in the following tables. After the reflux or heat treatment period and, unless otherwise noted, the samples were filtered through a pre-weighed glass fiber filter using a millipore funnel. The filters were washed with heptane, dried in an oven at 110° C., allowed to cool for 30 minutes, and weighed. The mother liquors were transferred to pre-weighed beakers and were then evaporated using the ASTM D-2274 procedure. The weight of the gums resulting from evaporation and the weight of the sediment collected on the filters for each particular test run were combined to find a total sediment level given in terms of mg/100 ml of the particular hydrocarbon liquid sample. Results are reported in Tables I to V following.

TABLE I

| | West Coast Refinery HTU-2 Charge Three Hour Reflux | |
|---|---|---|
| additive | active concentration (ppm) | sediment weight mg/100 ml |
| — | — | 50 |
| Comparative One[1] | 1,000 | 81 |
| Comparative Two[2] | 1,000 | 56 |
| Example One[3] | 1,000 | 30 |

[1]mixture of commercially available amine antioxidants
[2]butylated hydroxytoluene - 2,6-di-tert-butyl-para-cresol
[3]2-amino-2-methyl-1-propanol
initial gum = 31 mg/100 ml

TABLE II

| | West Coast Refinery 400° F. Heat Treatment Three Hours | |
|---|---|---|
| additive | active concentration (ppm) | sediment weight *mg/100 ml |
| None (3 runs) | — | 300 (avg.) |
| Example One | 1,500 | 138 |
| Comparative Three[4] | 1,500 | 250 |
| Comparative Four[5] | 1,500 | 290 |

[4]diethylenediamine
[5]mixture of organic phosphites and amine antioxidants
*total solids were obtained by mixing 20 mils of DMF (dimethylformamide) with 100 mls of aged feedstock and allowing them to stand until occurrence of phase separation. When the separation process was completed, the DMF phase was removed. The DMF phase was transferred to a 100 ml beaker and was evaporated by the ASTM 2274 Test Method. The residual obtained from the evaporation was recorded as the total solids.
initial gum level - 64 mg/100 ml.

TABLE III

| | West Coast Refinery Upper Side Cut Feedstock (Three Hour Reflux Test) | |
|---|---|---|
| additive | active concentration (ppm) | sediment weight mg/100 ml |
| — | — | 24 |
| Comparative Five[6] | 1,000 | 28 |
| Comparative Six[7] | 1,000 | 29 |
| Comparative Seven[8] | 1,000 | 56 |
| Comparative Eight[8] (Inn.c) | 1,000 | 48 |
| Example One | 1,000 | 13 |

[6]diethylhydroxylamine
[7]dimethylformamide
[8]commercially available blend of organic phosphites and p-phenylene diamine
[9]heterocyclic amine compound
initial gum = 8 mg/ml

TABLE IV

| | West Coast Refinery #3 Diesel Feedstock 400° F. Heat Treatment - Three Hours | |
|---|---|---|
| additive | active concentration (ppm) | sediment weight mg/100 ml |
| Control (six runs) | — | 154 (avg.) |
| Example One | 1,500 | 76 |
| Comparative Nine[10] | 1,500 | 164 |
| Comparative Ten[11] | 1,500 | 217 |
| Comparative Three | 1,500 | 136 |
| Comparative Eleven[12] | 1,500 | 185 |
| Comparative Four | 1,500 | 113 |

TABLE V

| | West Coast Refinery Six Hour Reflux Test | |
|---|---|---|
| additive | active concentration (ppm) | sediment weight mg/100 ml |
| Control | — | 23 (avg.) |
| Comparative Four | 600 | 34 |
| Example Two[13] | 600 | 11 |
| Example Three[14] | 600 | 10 |

[10]cyclohexylamine
[11]dicyclohexylamine
[12]mixture of tert-butyl phenols
[13]2-amino-2-ethyl-1,3-propandiol
[14]monoethanolamine

TABLE VI

| additive | West Coast Refinery Bottoms Feeds Five Hour Reflux active concentration (ppm) | sediment weight mg/100 ml |
|---|---|---|
| Control (six runs) | — | 8 (avg.) |
| Comparative Twelve[15] | 1,000 | 48 |
| Comparative Two | 1,000 | 31 |
| Comparative Six | 1,000 | 52 |
| Comparative Five | 1,000 | 15 |
| Comparative Thirteen[16] | 700 | 11 |
| Comparative Fourteen[17] | 700 | 16 |
| Example One | 1,000 | 2 |
| Example Three | 1,000 | 1 |

[15]commercially available phosphite containing compound
[16]cyclohexylamine
[17]hexylamine
initial gum = 1 mg/100 ml.

DISCUSSION

In accordance with Tables I–V, it can be seen that the tested alkanolamines are effective in reducing sediment and gum formation in the test liquid hydrocarbon mediums after same have been heat treated. In fact, the alkanolamine compounds tested performed better than the commercially available comparative example materials, many of which are sold for the purpose of inhibiting fouling in distillate fuels, etc.

While this invention has been described with respect to particular embodiments thereof, it is apparent that numerous other forms and modifications of the invention will be obvious to those skilled in the art. The appended claims and this invention generally should be construed to cover all such obvious forms and modifications thereof which are within the true spirit and scope of the present invention.

I claim:

1. A method of inhibiting the formation of gum and sediment in a liquid consisting of a liquid hydrocarbonaceous medium during heating of said medium at elevated temperatures of from about 100° F.–2000° F., comprising adding to said medium an amount effective to inhibit said formation of gum and sediment otherwise formed as a result of said heating of a $C_1$–$C_8$ alkanolamine having vicinal hydroxy and amino location.

2. A method as recited in claim 1 wherein said alkanolamine comprises a member selected from the group consisting of 2-amino-2-methyl-1-propanol, 1-amino-2-hydroxyethane, and 2-amino-2-ethyl-1,3-propanediol.

3. A method as recited in claim 1 wherein said hydrocarbonaceous medium comprises a member selected from the group consisting of crude oils, kerosene, diesel fuel, jet fuel, naphtha, lube oil, catalytic cracker feedstock, light and heavy cycle oils, resids, olefinic process streams, naphthenic process streams, ethylene glycol, and aromatic hydrocarbons.

4. A method as recited in claim 1 wherein said alkanolamine is added in an amount of about 1.0 part to about 10,000 parts per million of said liquid hydrocarbonaceous medium.

5. A method as recited in claim 4 wherein said alkanolamine is added in an amount of from about 1.0 part to about 1500 parts per million of said liquid hydrocarbonaceous medium.

6. A method as recited in claim 1 wherein said heating is conducted at temperatures of about 600° F.–1000° F.

7. A method as recited in claim 1 wherein said alkanolamine is dissolved in an organic, non-polar solvent.

8. A method as recited in claim 1 wherein said hydrocarbonaceous medium comprises a butadiene process liquid.

9. A method as recited in claim 1 wherein said hydrocarbonaceous medium comprises feedstock to a pyrolytic gasoline process.

10. In a hydrodesulfurization process of the type wherein sulfur and undesirable metal contaminants content of a liquid hydrocarbonaceous medium are reduced by heat treatment and pressurized catalytic reaction, wherein said medium is heated to temperatures of about 450°–780° F. and is subjected to pressure of about 600–3000 psig, the improvement comprising inhibiting gum and sediment formation in said liquid hydrocarbonaceous medium otherwise formed as a result of said heat treatment and pressurized catalytic reaction by adding to said medium an effective amount to inhibit said gum and sediment formation of a $C_1$–$C_8$ alkanolamine having vicinal hydroxy and amino location.

11. A process as recited in claim 10 wherein said medium comprises a member selected from the group consisting of naphtha, diesel fuel, kerosene, and light gas oils.

12. A method as recited in claim 10 wherein said alkanolamine comprises a member selected from the group consisting of 2-amino-2-methyl-1-propanol, 1-amino-2-hydroxyethane, and 2-amino-2-ethyl-1,3-propanediol, and wherein from 1 to 10,000 parts of said alkanolamine are added based on one million parts of said liquid hydrocarbonaceous medium.

13. A method as recited in claim 12 wherein said alkanolamine is 2-amino-2-methyl-1-propanol.

14. A method as recited in claim 12 wherein said alkanolamine is 1-amino-2-hydroxyethane.

15. A method as recited in claim 12 wherein said alkanolamine is 2-amino-2-ethyl-1,3-propanediol.

16. A method for inhibiting the degradation of, and particulate and gum formation in distillate fuel oils during elevated temperature processing thereof at temperatures of from about 100°–2000° F. which comprises adding to the distillate fuel oil during said elevated temperature processing an effective inhibiting amount of a $C_1$–$C_8$ alkanolamine having vicinal hydroxy and amino location.

17. The method of claim 16 wherein said $C_1$–$C_8$ alkanolamine is added in an amount from about 1.0 part to about 10,000 parts per million parts of said fuel oil.

18. A method as recited in claim 16 wherein said alkanolamine comprises a member selected from the group consisting of 2-amino-2-methyl-1-propanol, 1-amino-2-hydroxyethane, and 2-amino-2-ethyl-1,3-propanediol.

19. A method as recited in claim 18 wherein said alkanolamine is 2-amino-2-methyl-1-propanol.

20. A method as recited in claim 18 wherein said alkanolamine is 1-amino-2-hydroxyethane.

21. A method as recited in claim 18 wherein said alkanolamine is 2-amino-2-ethyl-1,3-propanediol.

22. A method as recited in claim 16 wherein from about 1 to 10,000 parts of said alkanolamine are added based upon one million parts of said distillate fuel oil.

23. A method for inhibiting the degradation of, and particulate and gum formation in blended diesel fuel during processing at elevated temperatures of from about 100°–2000° F. which comprises adding to said diesel fuel during said elevated temperature processing an effective amount of a $C_1$–$C_8$ alkanolamine having vicinal hydroxy and amino location.

24. A method as recited in claim 23 wherein said blended diesel fuel is treated at heated temperatures of from about 100° F. to about 800° F. and wherein said alkanolamine is added in an amount of about 1 part to 10,000 parts based upon one million parts of said diesel fuel.

25. A method as recited in claim 23 wherein said alkanolamine comprises a member selected from the group consisting of 2-amino-2-methyl-1-propanol, 1-amino-2-hydroxyethane, and 2-amino-2-ethyl-1,3-propanediol.

26. A method as recited in claim 25 wherein said alkanolamine is 2-amino-2-methyl-1-propanol.

27. A method as recited in claim 25 wherein said alkanolamine is 1-amino-2-hydroxyethane.

28. A method as recited in claim 25 wherein said alkanolamine is 2-amino-2-ethyl-1,3-propanediol.

* * * * *